US005867843A

United States Patent [19]

Robello et al.

[11] Patent Number: 5,867,843

[45] Date of Patent: Feb. 9, 1999

[54] AUTOMATIC TOILET SEAT LOWERING APPARATUS

[76] Inventors: Russell J. Robello; Deborah A. Robello, both of 10481 NW. 9th Pl., Coral Springs, Fla. 33071-5633

[21] Appl. No.: 956,524

[22] Filed: Oct. 23, 1997

[51] Int. Cl.[6] ..... A47K 13/10

[52] U.S. Cl. ..... 4/246.1; 4/246.2; 4/246.3

[58] Field of Search ..... 4/246.1, 246.2, 4/246.3, 246.4, 246.5, 248, 250, 408, 249

[56] References Cited

U.S. PATENT DOCUMENTS

| | | | |
|---|---|---|---|
| 3,284,810 | 3/1964 | Stokes | 4/246.1 |
| 4,491,989 | 1/1985 | McGrall | 4/251 |
| 4,551,866 | 11/1985 | Hibbs | 4/251 |
| 5,369,814 | 12/1994 | Denys | 4/246.2 |
| 5,371,906 | 12/1994 | Tzang | 4/246.1 |
| 5,504,947 | 4/1996 | Robello . | |
| 5,604,936 | 2/1997 | Mausolf | 4/246.1 |
| 5,781,938 | 7/1998 | Anderson | 4/246.1 |

*Primary Examiner*—J. Casimer Jacyna
*Assistant Examiner*—Kerry S. Culpepper
*Attorney, Agent, or Firm*—McHale & Slavin, PA

[57] ABSTRACT

An automatic closing seat apparatus that operates on a controlled release of air. A control cylinder is formed integral to a seat cover with magnets available for securing the seat cover and seat in a tandem position. A water sensor is positioned in a conventional water closet to allow for release of air when the water level drops during the flushing of the toilet bowl. The shut off valve can control the flow rate of air between the seat cover and the water closet to operate as a shut off switch to prohibit unauthorized entry into the toilet bowl area.

20 Claims, 5 Drawing Sheets

AUTOMATIC TOILET SEAT LOWERING APPARATUS

FIELD OF THE INVENTION

This invention is directed to toilet seat closures and in particular to an improved apparatus formed integral with a toilet seat cover for automatically lowering a lifted toilet seat and toilet seat cover.

BACKGROUND OF THE INVENTION

Automated toilet-covering devices are known in the plumbing industry. For example, the Applicant invented the automatic toilet seat lowering apparatus depicted in U.S. Pat. No. 5,504,947. That device teaches an automatic toilet seat closing construction that can be attached to an existing toilet. The apparatus lowers a raised toilet seat through use of a sealed piston and cylinder. This control cylinder is connected to an air tube and allows unresisted toilet seat lifting. However, the seat will not close until a valve on the air tube is opened to allow air to escape from the control cylinder. The air tube includes a float valve that opens when the toilet is flushed and the water level in the toilet is temporarily lowered. The '947 device is attached via a bracket to the side of a conventional toilet. The control piston is mounted adjacent to the toilet seat and automatically lowers the toilet seat and seat cover whenever the water in the water closet drops below a predetermined level. The required water lowering occurs when the toilet is flushed and the water in the toilet tank rinses the bowl. When this water level drops, a floating valve is opened and the otherwise-sealed control cylinder allows the seat and seat cover to close.

Although males sometimes use a toilet with the seat raised, proper etiquette suggests that the seat be lowered after use. And, while some males are accustomed to lowering the seat after use, many are not so accustomed. Failure to lower the seat may lead to conflict if both women and men must share a given toilet. Such conflict may result in strained relations between spouses.

For the above reasons, the inventor developed the device taught in the 5,504,947 patent. Through use, however, the inventor has discovered certain improvements that increase the device's usefulness, simplify the device's installation, and improve the device's overall appearance. Other seat positioning devices have also been created.

U.S. Pat. No. 4,995,120 discloses a toilet seat closing device incorporating a reversible direct current motor which is coupled to a ratcheting clutch mechanism attached to the toilet seat. The problem arises in that electricity is not commonly available close to the toilet. Installation necessitates either an electrical cable drawn through the washroom or an electrical socket placed near the toilet. In either event, electricity and water can lead to a dangerous situation as it is not uncommon for a toilet to overflow.

U.S. Pat. No. 5,058,216 discloses a compressible actuator positioned within the water closet capable of sending air pulses to a bladder placed between the water closet and seat cover. When the actuator is sufficiently compressed it expands the bladder causing the seat cover to be pushed, closing the seat. A problem with this device is that no provision is made to set the seat down gently allowing the possibility that such a quick closure will cause the base of the toilet to shatter. Thus, this disclosure requires the use of enlarged bumpers placed beneath the seat so as to cushion the impact.

U.S. Pat. No. 5,280,653 discloses an energy transceiver comprised of a spring with a pressure plate acting as its seat in a controlled drum. The energy transceiver accumulates potential energy released by the toilet seat during the descent to a point where closure of the seat stops the operating fluid thereby releasing the energy accumulated therein. This device is unique, yet quite complicated and by its very nature necessitating direct connection to the water which may lead to early fouling of the apparatus.

U.S. Pat. No. 5,289,593 discloses still another automatic closure device for toilet seats. This embodiment discloses the use of a weight having a specific gravity slightly higher than water. A cable is attached between the weight and the seat allowing for the lowering of the seat. When the toilet is flushed the water table in the water closet increases the force supplied by the weight and pulls on the cable. While an objective of the disclosure is simplicity, it is noted that proper positioning of a weight and pulley mechanism must be performed for operation.

U.S. Pat. No. 5,369,814 discloses yet another seat closing device. This disclosure allows for closure by use of a water actuated piston which couples to the pressure side of an incoming water line. While this invention has greatly simplified devices of the prior art, it still requires coupling to a component that may lead to subsequent problems. Namely, any time a component that has movable parts coupled to water has a possibility of leaking which may result in flooding of the bathroom. In addition, despite the simplicity of the disclosure the necessity remains that a water line must be spliced and pressure tubing installed for handling of water pressure.

Thus, what is needed is in the art is an inexpensive, automatic toilet seat closing device that operates without electricity and may be installed without mechanical aptitude. The seat closing device should also prevent unwanted lifting of the toilet seat or seat cover. Furthermore, the device should lower the toilet seat and seat cover in unison, if both are raised. The device should also prevent toilet seat cover lowering if the seat is occupied, even if the toilet is flushed.

SUMMARY OF THE INVENTION

The instant invention teaches an automatic toilet seat lowering apparatus that is formed integral with a toilet seat cover. This arrangement conceals the mechanics of operation from view and simplifies the installation procedure. The apparatus includes a modified toilet seat and seat cover combination; existing toilets may be retrofitted with the present device. Such a retrofit involves unbolting the existing seat and seat cover and bolting on the replacement seat and seat cover. Once the new seat and cover are secured in place, a float valve is placed within the water closet and suspended from the top edge of a water closet wall. The present apparatus may be installed by the consumer, since only simple tools are needed and no mechanical background is required.

The seat cover incorporates a pneumatic cylinder that is located within the seat cover and concealed from view by a removable panel. The pneumatic cylinder has sufficient strength to support the seat and seat cover simultaneously in a fully-raised position. The attached seat cover is preferably releasably secured to the seat by the integrated magnets concealed within the seat and seat cover. Although the magnets are hidden from view, they provide sufficient adherence to allow the seat and seat cover to be lowered as a unit. As a result, if both the seat and seat cover have been lifted in preparation for toilet use, then both the seat and seat cover are lowered in tandem, as a magnetically-joined unit, when the toilet is flushed. Alternately, if only the seat cover has been raised, then only the seat cover is lowered when the toilet is flushed.

The motion of the seat and seat cover is governed by the integrated control cylinder and an air tube that contains a system of valves. The control cylinder includes a piston that slides within a cylinder housing. The cylinder is sealed except for a forked air tube that extends from the cylinder. The first branch of the forked tube terminates in a float valve positioned within the toilet water closet. The float valve opens when the water level in the water closet drops, and closes as the water is replenished. The second branch of the fork includes a one-way check valve and a safety shutoff valve. Air can flow into the air tube through the one-way check valve, but the check valve does not allow air to exit. Furthermore, closing the shutoff valve prevents lifting of the seat or seat cover.

The arrangement of the air tube branches and valves in the present apparatus provides an increased level of seat position control. By combining a one-way check valve and shutoff valve with a float valve, the present invention provides a novel control system that allows an individual to control toilet seat motion in ways not possible before. Not only will the seat and seat cover lower only after the toilet has been flushed, the seat may be locked in a closed position to prevent unwanted access to the toilet bowl, and the device now includes a weight-sensing, flush-override feature that keeps the seat cover raised if the seat is occupied, even if the toilet is flushed.

The float valve of the first branch works with the check valve of the second branch to ensure that the seat and cover will lower only when the toilet has been flushed. When the seat or seat cover is raised, the piston rod moves within the cylinder housing from a withdrawn position to an extended position. This motion generates a syringe-like suction that draws extra air through the second branch and into the cylinder housing. Unless expelled, the extra air drawn into the cylinder housing will prevent the piston rod from returning to the withdrawn position. Accordingly, the raised seat and seat cover will remain raised until the extra air is expelled from the housing. Since air cannot exit the air tube through the check valve in the second branch, the first branch represents the only possible air exit. Since the float valve is supported only by the water in the water closet, flushing the toilet will open float valve, creating an escape path for extra air in the cylinder housing. As air exits through past the float valve, through the open end of the first branch, the piston returns to its withdrawn position. The seat cover, and seat if raised, are lowered as a result of this piston motion.

Additionally, the safety shutoff valve will prevent unwanted lifting of the seat and seat cover. Since the float valve is suspended by water in the water closet, the float valve is closed when the water closet is full. When the float valve is closed, air does not enter the air tube through the first branch. As a result, air can enter the air tube only through the second branch. If the shutoff valve, which is on the second branch, is closed, then air cannot enter the air tube at all. This effectively locks the piston rod in place and freezes the seat and seat cover. Because of the syringe-like suction described above, the piston rod will not move to its extended position unless extra air can enter the cylinder housing. In other words, if the shutoff valve is closed, extra air cannot be drawn into the air tubes to reach the cylinder housing. When extra air cannot reach the cylinder housing, the piston rod will not move, and the attached seat cover and seat are locked in place. This allows a parent to prohibit a child from lifting the seat or seat cover to prevent accidents. Closing the shutoff also prohibits large dogs from lifting the seat and drinking from the bowl.

The present invention also prevents lowering of the toilet seat cover when the seat is occupied, even if the toilet is flushed. The air tube is directed under the seat to pass between a seat support foot and the porcelain toilet bowl. The weight present on the seat when occupied forces the seat support foot to compress the air tube that passes between the foot and the porcelain bowl. Compressing the air tube traps air within the air tube and prevents extra air in the cylinder housing from passing into the air tube. As a result, even if the toilet is flushed and the float valve is opened, air will remain in the cylinder housing and the piston rod will remain in the extended position. Flushing the toilet will not lower the seat cover if the seat is occupied; air is trapped within the cylinder housing and the piston remains locked in place. This also helps prevent seat closure is the float valve becomes worn over time. The flush-override feature will compensate for a float valve that has become less effective, ensuring that the seat and cover do not begin to close before the toilet is flushed.

The air tube also includes an adjustable regulator valve. The regulator valve controls the flow rate of air exiting the air tube. The regulator valve allows adjustment of the seat-lowering rate, as needed. Seats and seat covers of various weights may therefore be lowered in a controlled manner by the present device.

Thus an objective of the instant invention is to provide a one piece toilet replacement device that provides automatic seat closure and may be installed without the need for specialized skill.

Still another object of the instant invention is to teach the use of a control valve that inhibits the flow of air between a pneumatic actuator to selectively prohibit opening of the seat and seat cover.

Yet still another object of the instant invention is to teach an integrated seat that incorporates an air shut off to prohibit unwanted closure of a seat cover while the toilet is in use.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Figure 1:
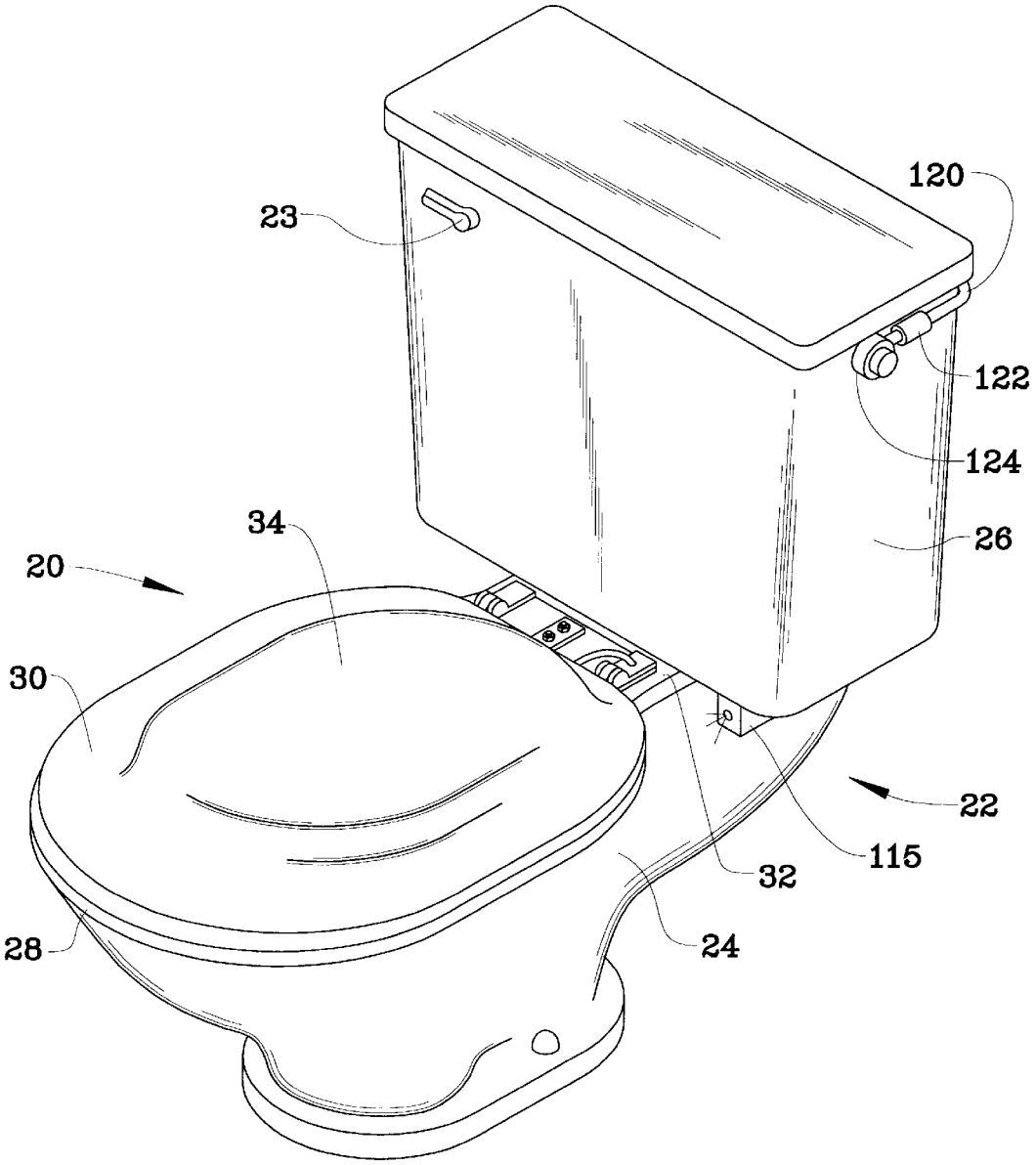
FIG. 1 is a perspective view of a toilet and a water closet with the instant invention installed.

It is to be understood that while a certain form of the invention is illustrated, it is not to be limited to the specific form or arrangement, of parts herein described and shown. It will be apparent to those skilled in the art that various changes may be made without departing from the scope of the invention and the invention is not to be considered limited to what is shown in the drawings and described in the specification.

Figure 2:
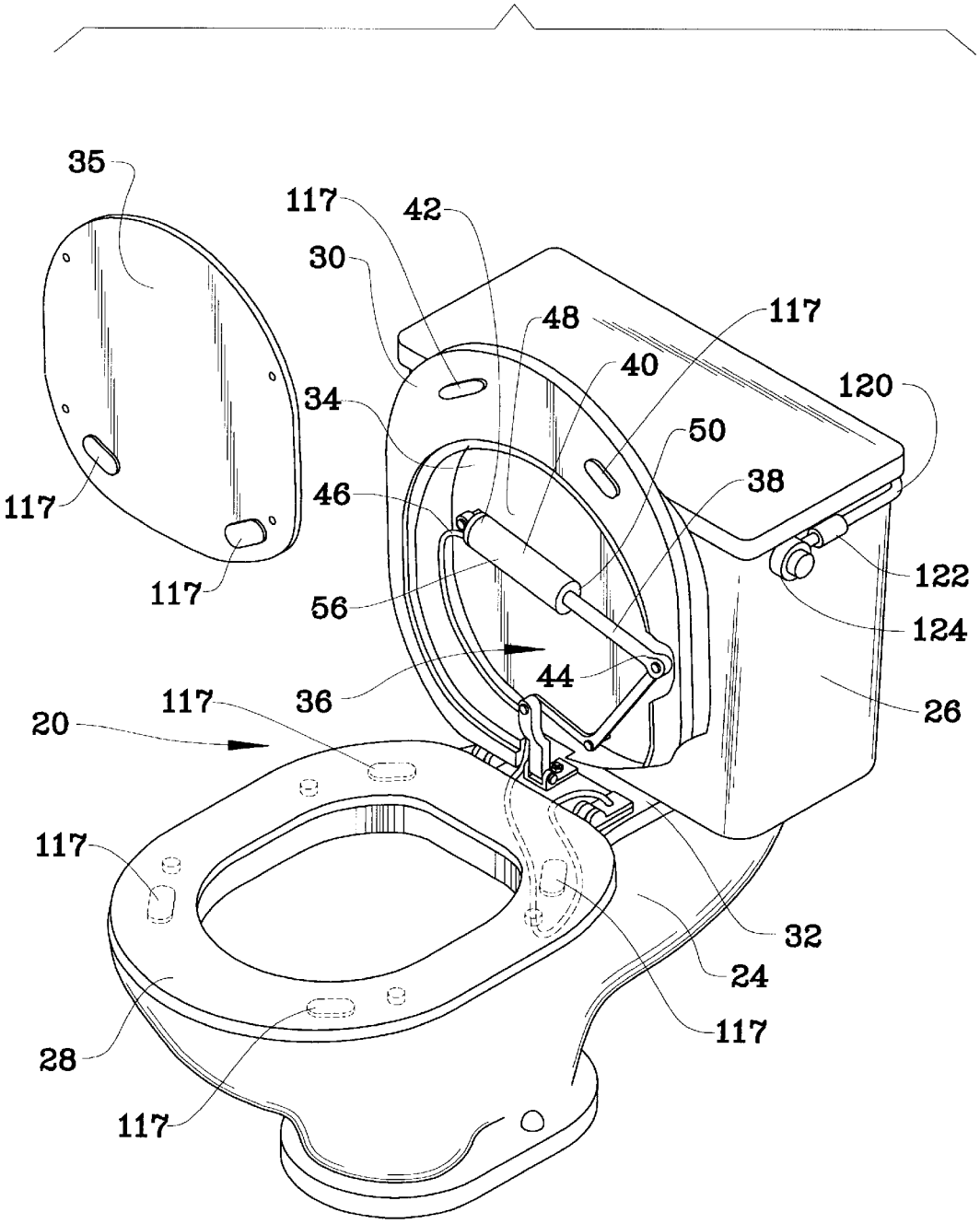
FIG. 2 is a perspective view of the instant invention with the seat cover in an open position and the housing compartment revealed.

Now with respect to FIGS. 1 and 2, the improved automatic toilet seat lowering apparatus 20 is shown installed on a toilet 22. The toilet includes a porcelain bowl 24 in fluid connection with a water closet or tank 26. The tank includes a flush lever 23. A seat 28 and seat cover 30 are hingedly attached to an upper surface 32 of said bowl 24. The seat cover 30 is contoured and includes a housing compartment34 that is concealed by a removable panel 35 during use.

Figure 3:
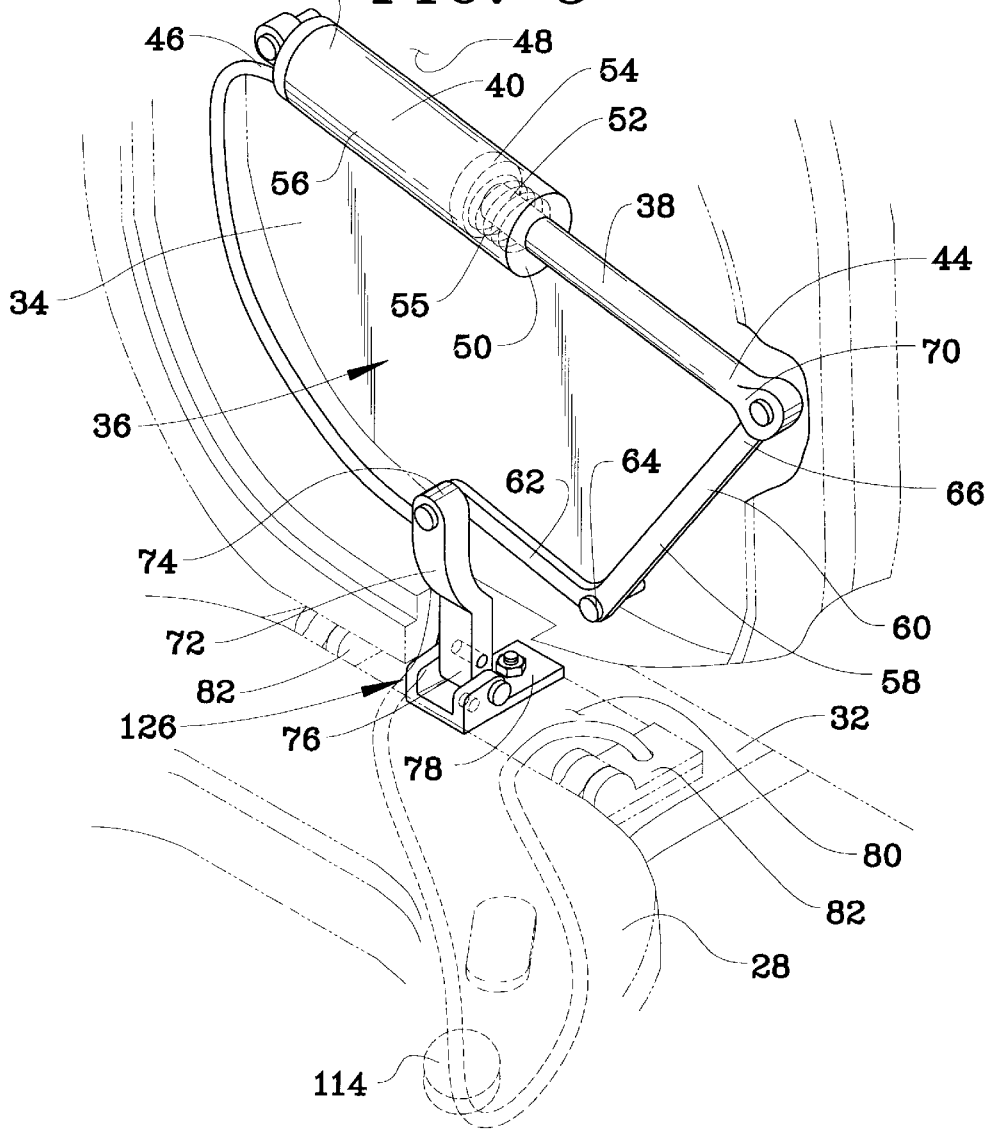
FIG. 3 is a close-up view of the instant invention showing the associated linkage disposed within the housing compartment.

As shown in FIGS. 2 and 3, a control cylinder construction 36 is located within the housing compartment 34. The cylinder construction 36 includes a piston rod 38 slidably mounted within a substantially-hollow cylinder shell 40. The piston shell 40 is characterized by a first end 42 and an opposite second end 44. The piston shell first end 42 is closed except for a vent nozzle 46 that is fluidly coupled with the piston housing 40. The first end 42 is attached to the housing compartment interior surface 48. The piston shell second end 44 includes an end plate 50 through which a piston rod first end 52 passes. The piston rod first end 52 includes a piston seal 54 that moves with the piston first end 52 as the piston rod 38 slides within the piston shell 40. In a first embodiment, the piston seal 54 cooperates with the continuous sidewall of the piston shell 40 and the piston shell first end 42 to form an airtight chamber 56. The vent nozzle 46 is the only conduit through which air may enter or leave the airtight chamber 56. As the piston rod 38 and attached seal 54 move within the piston shell 42, the volume of the airtight chamber 56 changes accordingly. A biasing spring 55 urges the piston rod into a retracted position within the piston housing 40. However, because the chamber 56 is airtight, the piston rod 38 and attached seal 54 will move within the piston shell 40 only if air travels through the vent nozzle 46. In other words, stopping airflow through the vent nozzle 46 will lock the piston rod 38 in place with respect to the piston shell 40. In an additional embodiment, the seal 54 only prevents airflow in one direction. The seal is shaped and sized to resist air exit from the chamber 56, but air will flow around the seat 54 to enter the chamber.

Figure 3A:
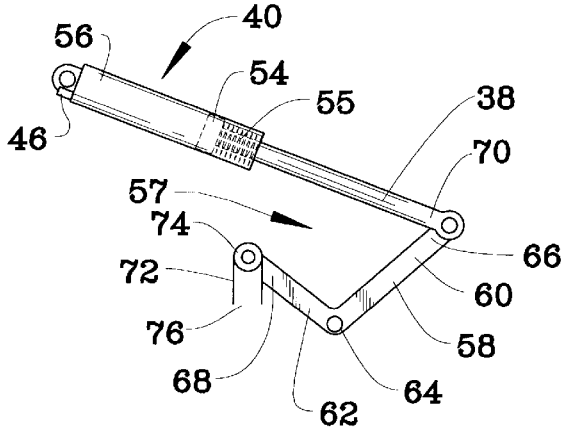
FIG. 3A is a diagrammatic view of the linkage of the instant invention in an open position.
Figure 3B:
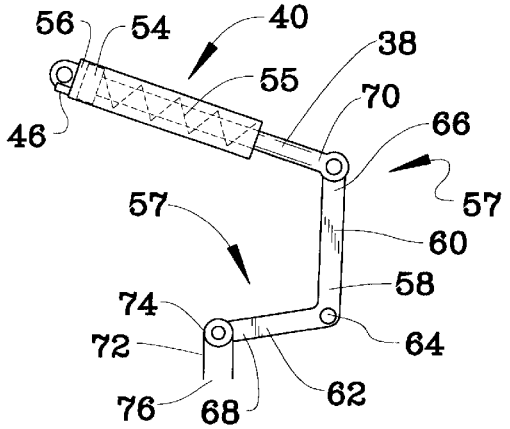
FIG. 3B is a diagrammatic view of the linkage of the instant invention in an closed position.

Now referring to FIG. 3, with additional reference to FIGS. 3A and 3B, the apparatus includes a multi-part seat closure linkage 57. One element of the closure linkage is a rigid, L-shaped coupler 58. The coupler is characterized by a first arm 60 and a second arm 62. The angle between the coupler arms 60,62 is fixed, and the arms abut each other at an coupler attachment corner 64. The attachment corner 64 is pivotally pinned to the housing compartment interior surface 48.

The coupler arms 60,62 are coplanar and each arm extends from the attachment corner 64 to terminate in a traveling end 66,68. The traveling end 66 of the linking member first arm 60 is pivotally pinned to a second end 70 of the piston rod 38. As a result, the coupler 58 pivots about the attachment corner 64 in response to motion of the piston rod 38 within the piston shell 40.

An additional element in the linkage is an actuator arm 72. The actuator arm 72 is a contoured rod having a first end 74 spaced apart from a second end 76. The actuator arm first end 74 is pinned to the traveling end 68 of the coupler second arm 62. The actuator arm second end 76 is hingedly connected to the upper surface of the toilet bowl 24 by an attachment bracket 78 mounted on a support base 80. The support base 80 may be formed integral with the toilet bowl 24, or the base may be a separate piece. In the present embodiment, the support base 80 is a rectangular plate held in place by seat mounting hinges 82. The mounting hinges 82 are bolted to the toilet bowl upper surface 32 and hold the support base in compression against the bowl upper surface. The hinges 82 allow the seat 28 and seat cover 30 to pivot between an open position and a closed position, relative to the bowl 24. Furthermore, the attachment hinges 82 have slotted bolt-engaging bores, not shown, to accommodate various-sized seat 28 and bowl 24 combinations.

The control cylinder construction 36 and seat closure linkage 57 cooperate to direct motion of the seat cover 30. As described above, the control cylinder construction 36 and actuator arm 72 are attached to the seat cover 30 and bowl upper surface 32, respectively. The cylinder construction 36 and actuator arm 72 are also operatively linked by the pivoting coupler 58. Because of this arrangement, the control cylinder 36 and the pivoting coupler 58 move in tandem with motion of the seat cover 30.

With continued reference to FIGS. 3, 3A, and 3B, the relative positions of the piston rod 38, the coupler 58, and the actuator arm 72 are shown when the seat cover 30 occupies various positions. When the seat cover 30 is fully opened, as depicted in FIG. 3A, the piston rod 38 is in an extended position with respect to the piston shell 40. As the piston rod 38 slides to this extended position, air passes through the vent nozzle 46 and fills the air-tight piston chamber 56. The coupler 58, which joins the extended rod second end 70 with the actuator arm first end 74, occupies an open-seat-cover position.

As the seat cover 30 closes, the piston rod 38 slides within the piston shell 40 to occupy a retracted position, depicted in FIG. 3B. As the rod 38 moves into the shell 40, air is forced out of the air-tight piston chamber 56 through the vent nozzle 46. In response, the rigid coupler 58, which still links the piston rod 38 and the actuator arm 72, pivots to a closed-seat-cover orientation. As the seat cover 30 is lowered, the angle between the actuator arm 72 and the bowl upper surface 32 approaches zero degrees. When the seat cover 30 is fully closed, the actuator arm 72 and bowl upper surface 32 occupy substantially-parallel planes.

Moving the seat cover 30 between the open and closed orientations requires that air move through the vent nozzle 46. As the seat cover 30 is lifted, the piston rod 38 and seal 54 slide within the shell 40. This syringe-like motion draws air through the vent nozzle to fill the expanding air-tight piston chamber 56. Alternately, as the seat cover 30 is lowered, the piston rod 38 and seal 54 slide into the piston shell 40, forcing air through the vent nozzle 46, out of the shrinking air-tight chamber 56. However, if air flow through the nozzle is restricted or stopped, then piston rod 38 motion is accordingly slowed or prevented. Because of the linkage 57 associated with the present invention, preventing or slowing motion of the piston rod 38 will advantageously stop or slow motion of the seat cover 30. As a result, controlling air flow through the vent nozzle 46 is an effective way to control motion of the seat cover 38 of the present apparatus 20. In keeping with the objects of this invention, the present apparatus 20 includes various features that capitalize on this relationship to provide increased toilet seat control.

Figure 4:
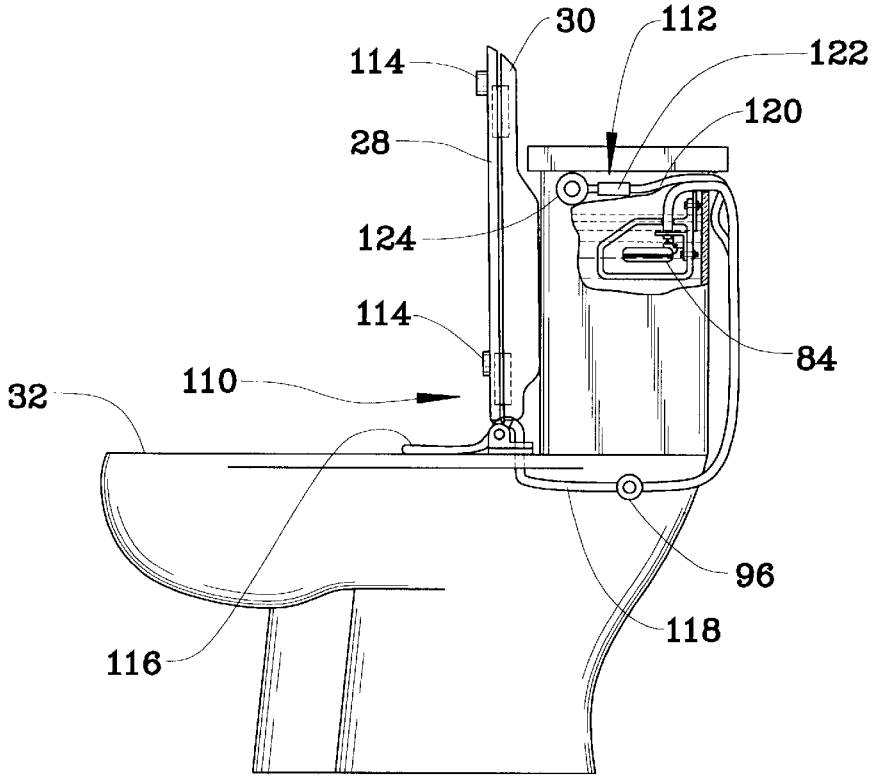
FIG. 4 is a side view of the instant invention showing associated air tubing and a supported float valve.
Figure 5:
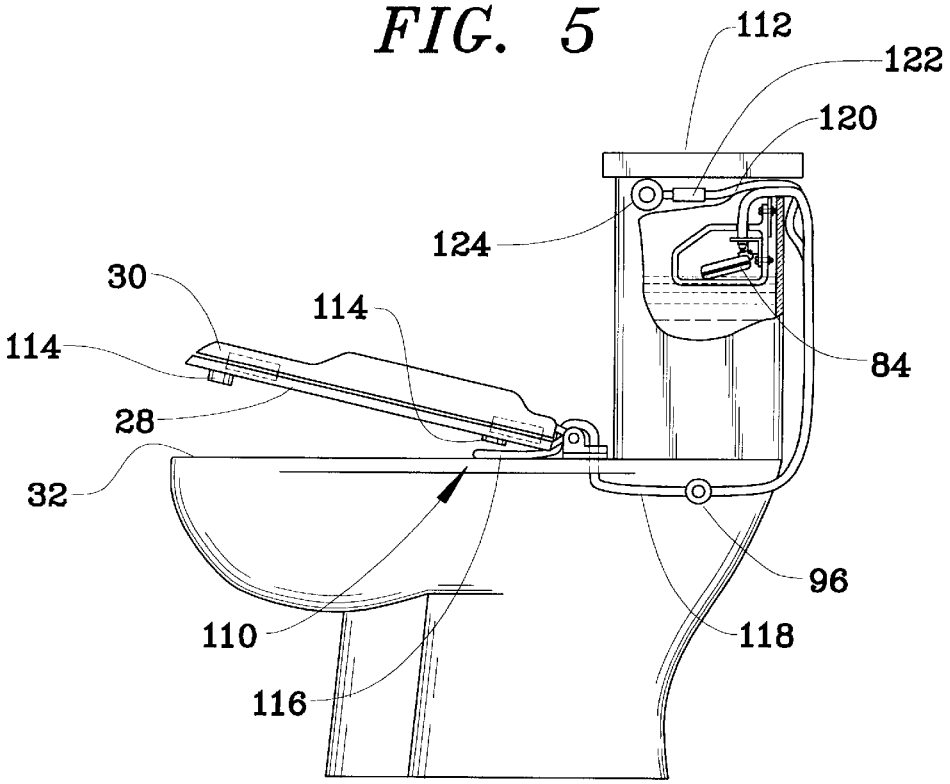
FIG. 5 is a side view of the instant invention showing associated air tubing a lowered float valve.

As shown in generally in FIGS. 4, and 5, the apparatus includes a water level sensor 84 that automatically lowers the toilet seat cover 30 after the toilet is flushed. With additional reference to FIGS. 6 and 7, the water level sensor 84 is shown with an inverted U-shaped bracket 86 which allows the device to be placed into the water closet of a toilet bowl. The bracket 86 places a float housing 88 beneath the water line in the water closet when the water closet is in its normally filled position. Float housing 88 has an outer wall 90 which encompasses float 92 in a protective manner with sufficient openings as shown by open cavity 94 to allow water to access the float 92. As described below, the float controls the release of air from control cylinder 36 by use of a flexible air tube 118. The air tube 118 is preferably concealed and extends from the vent nozzle 46 and fluidly couples the components together. The velocity of air released is controlled by regulator valve 96 placed in-line, the valve permits the escape of air to be controlled allowing variable speed selection for retraction of the piston rod 38.

Figure 6:
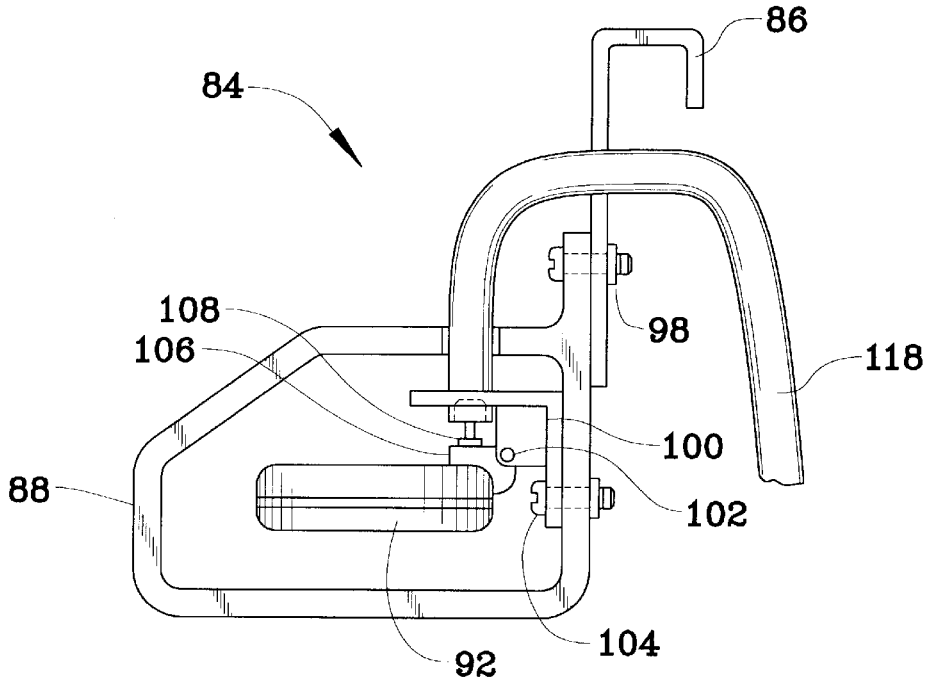
FIG. 6 is a side view of a float valve.
Figure 7:
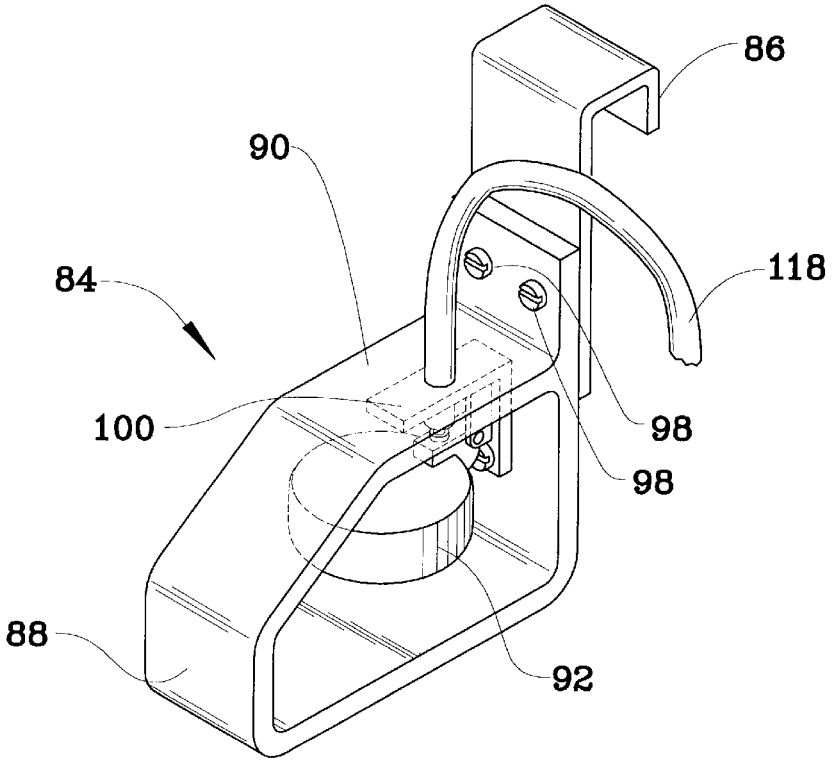
FIG. 7 is a perspective view of the float valve.

Referring still to FIGS. 6 and 7, the water level sensor 84 of the apparatus consists of a bracket 86 coupled to a housing 88 by use of attachment screws 98. Float 92 is pivotally connected by float bracket 100 using pinion 102 and is coupled to housing 88 by bolt 104. The float 92 has needle platform 106 for lifting of the needle valve projection 108 in relation to the positioning of the float 92. In operation, when the water level sensor means 84 is placed within a water closet, the water will lift float 92, forcing the needle valve projection 108 into a needle seat, not shown, and prevent air from escaping out of the flexible air tube 118. When the water level drops the tank float 92 is lowered, allowing the needle valve projection 108 to drop away from platform 106. This drop allows air in the control cylinder 36, which is fluidly coupled with the flexible air tube 118, to exit the tube and escape past the needle valve projection 108. The seat cover 30 is lowered as the air escapes.

As stated above, the flexible air tube 118 is coupled to regulator valve 96. Adjusting the regulator valve changes the rate of air released from the cylinder. This valve 96 works in conjunction with the biasing spring 55, allowing for customized seat lowering rates.

It should be noted that the instant invention operates with water saving tanks as well as hand and electric pumps commonly found on mobile homes and boats. In such instances, water is not held in a conventional water closet wherein a flush lever is used to initiate transfer of water for purposes of flushing the toilet bowl. When the seat cover 30 is lifted, the piston rod 38 extends from control cylinder 36, allowing air transfer through vent nozzle 46 into the expanding chamber 56. The seat cover 30 is then allowed to close slowly, with the closure rate being adjusted by movement,of valve 96. The seat cover 30 may close over a period of time such as two or more minutes. This slow closure inhibits slamming of the toilet seat should the motor home hit a bump or the boat hit a wave while under travel. In addition, water saving toilets that lack a conventional water closet are allowed the benefits of the automatic closure mechanism. In these situations, the apparatus 20 is fitted, as shown in FIG. 1, with an electronic motion sensor 115 that initiates an air release from the chamber 56 when an individual leaves the toilet 22. Alternately, the float 92 may, together with the needle projection 108 and the needle valve platform 106, be inverted. In this manner, the float 92 and needle projection 108 will still seal the air tube 118. However, in this alternate embodiment, the flush lever 23 will be connected to the weighted float 92. As a result, the needle valve projection 108 becomes unseated in response to flush lever 23 motion, rather than a water level decrease. It should also be noted that the support base 80 may be eliminated if the device is used in OEM applications where the support base is integral with the structure of the toilet bowl, all deemed to be within the scope of this invention.

As shown in FIGS. 2, 4, and 5, the apparatus 20 also includes a flush-override or weight-sensing feature 110 that prevents lowering of the seat cover 30 if the toilet 22 is flushed while the seat 28 is occupied. The flush override feature 110 incorporates support feet 114 that extend orthogonally from below the toilet seat 28. The feet 114 space the toilet seat 28 away from the toilet bowl upper surface 32 when the seat is in a closed position. A resiliently-deformable section 116 of the flexible air tube 118 is secured under one of the feet 114. So placed, the resiliently-deformable section 116 is sandwiched between the foot 114 and toilet bowl upper surface 32, when the seat 28 is fully lowered. When the seat 28 is occupied, the weight on the seat will pinch closed the hose section 116 that passes between the support foot 114 and the bowl upper surface 32, preventing air flow through the tube 118. As a result, even if the toilet is flushed and the float 92 drops, air will not leave the piston chamber 56, while the seat 28 is occupied. Therefore, the piston rod 38 will not move, and a raised toilet seat cover 30 will remain in the open position. Because the pinched section 116 is resiliently deformable, unloading the seat 28 allows air flow within the tube 118 to resume.

This weight-sensing, flush override feature 110 works in concert with the water level sensor: if the seat 28 is unloaded while the float 92 is lowered, the seat cover 30 will close. However, if the float 92 is suspended when the seat 28 is unloaded, the seat cover 30 will not close until the toilet 22 is flushed.

Magnets-117-concealed within the seat 28 and seat cover 30 provide a coupling force sufficient to move the seat in tandem with the seat cover. That is, if the seat 28 and seat cover 30 are raised together, the concealed magnets 117 secure the seat against the seat cover. As a result, the magnets 117 ensure that the seat 28 remains suspended until the seat cover 30 is lowered, and allow the seat and seat cover to close as a unit.

With reference to FIGS. 4 and 5, the apparatus 20 also includes a seat cover lock 112 that prevents unauthorized lifting of the toilet seat cover 30. As shown in FIGS. 4 and 5, the main air tube 118 is split and includes a cover lock branch tube 120 fluidly connected with the main air tube 118. The branch tube 120 includes a one-way check valve 122 that allows air to enter the branch tube, but does not allow air to return past the valve. When the water level sensor valve 84 is closed, such as when the toilet 22 is ready for use, the cover lock branch tube 120 is the only conduit through which air may reach the cylinder chamber 56. As such, in order to lift the seat cover 30, air must pass through the one-way check valve 122.

Since lifting the seat cover 30 causes the piston rod 38 to extend from the piston shell 40, air must enter the cylinder chamber 56, or a vacuum lock will prevent seat cover motion. Although the one-way check valve 122 does not restrict air flow to the piston chamber 56, the cover lock branch tube 120 includes a shut-off valve 124 that does. The shut-off valve 124 provides adjustable closure of the check valve branch tube 120. This adjustable closure allows an individual to regulate the air flow through the cover lock branch tube 120 to the control cylinder construction 36.

By completely closing the shut-off valve 124, an individual can prevent air from reaching the control cylinder construction 36, effectively locking the seat cover 30 closed. The shut-off valve 124 does not affect seat cover closure, because the one-way check valve 122 prevents air exit through the branch tube 120, regardless of shut-off valve 124 orientation.

Alternately, as seen in FIG. 3, in embodiments using air seals 54 that resist air flow in only one direction, a lock bar construction 126 selectively prohibits lifting of the seat cover 30. The lock bar construction 126 includes a sliding post that engages a bore in the attachment bracket 78 to secure the seat cover 30 in a closed position. The shut-off valve 124 is not needed when the lock bar is used.

Although the invention has been described in terms of a specific embodiment, it will be readily apparent to those skilled in this art that various modifications, rearrangements and substitutions can be made without departing from the spirit of the invention. The scope of the invention is defined by the claims appended hereto.

What is claimed is:

1. An automated toilet seat lowering apparatus adapted for use with a toilet bowl having an upper surface, said apparatus comprising:

a seat hingedly attached said upper surface of said toilet bowl;

a seat cover that is hingedly attached to said seat and includes a housing compartment;

a support base in fixed relation with said toilet bowl upper surface, including an attachment bracket;

a seat closure linkage assembly including a rigid coupler pivotally attached to an interior surface of said housing compartment, an actuator arm having a first end pivotally linked to a first end of said coupler, and a second end hingedly linked to said attachment bracket;

a control cylinder construction having a first end attached to said housing compartment interior surface, and a second end attached to a second end of said rigid coupler; and a valve means for regulating motion of said control cylinder construction, thereby providing adjustable spacing between said seat cover and said toilet bowl.

2. The automatic seat lowering apparatus of claim 1 further including:

a biasing spring operatively associated with said control cylinder construction to urge said seat cover from an open position to a closed position.

3. The automatic seat lowering apparatus of claim 1, wherein said control cylinder construction includes a piston chamber having a vent nozzle in fluid connection with said piston chamber; and a piston rod having a first end spaced apart from a second end, said first end slidably associated with said piston chamber, and said second end pivotally linked to said coupler.

4. The automatic seat lowering apparatus of claim 3, wherein said piston rod includes a cylinder seal, whereby air is directed through said vent nozzle in response to motion of said piston rod, and motion of said seat cover with respect to said toilet bowl is controlled.

5. The automatic seat lowering apparatus according to claim 1 wherein said support base is an integral portion of said toilet bowl.

6. The automatic seat lowering apparatus according to claim 1 wherein:

said toilet seat and said seat lid include magnets located and oriented to selectively provide a coupling force such that said seat and said seat lid to move as a unit.

7. An automated toilet seat lowering apparatus adapted for use with a toilet; said toilet including a bowl having an upper surface, a water closet fluidly coupled with said bowl, and a lever for releasing mater contained in said toilet to drain; said apparatus comprising:

a seat hingedly attached to said upper surface of said toilet bowl;

a seat cover that is hingedly attached to said seat and includes a housing compartment;

a support base in fixed relation with said toilet bowl upper surface, including an attachment bracket;

a seat closure linkage assembly including a rigid coupler pivotally attached to an interior surface of said housing compartment; and an actuator arm having a first end pivotally linked to a first end of said coupler, and a second end hingedly linked to said attachment bracket;

a control cylinder construction having a first end attached to said housing compartment interior surface, and a second end attached to a second end of said rigid coupler;

a water level sensor positioned in said water closet for monitoring a level of water within said water closet and allowing said control cylinder construction to change length when said level of water drops below a predetermined height;

a weight sensor for preventing closure of said seat lid while a predetermined amount of weight is present on said seat, even if said water level is below said height; and a seat cover lock for selectively securing said seat and seat lid in a closed orientation.

8. The automatic seat lowering apparatus of claim 7 further including:

a biasing spring operatively associated with said control cylinder construction to urge said seat cover from an open position to a closed position.

9. The automatic seat lowering apparatus of claim 7, wherein said control cylinder construction includes a piston chamber having a vent nozzle in fluid connection with said piston chamber; and a piston rod having a first end spaced apart from a second end, said first end slidably associated with said piston chamber, and said second end pivotally linked to said coupler.

10. The automatic seat lowering apparatus of claim 9, wherein said piston rod includes a cylinder seal, whereby air is directed through said vent nozzle in response to motion of said piston rod, and motion of said seat cover with respect to said toilet bowl is controlled.

11. The automatic seat lowering apparatus of claim 7, further including an air tube, wherein:

said water level sensor is coupled to said piston chamber via said air tube and includes a float valve supported by said level of water, said float valve having a needle projection that seals said air tube and prevents exit of air trapped in said piston chamber until said level of water is below said predetermined level.

12. The automated toilet seat apparatus of claim 11 further including a regulator valve disposed on said air tube to control velocity of air leaving said piston chamber.

13. The automated toilet seat apparatus of claim 11, wherein said air tube is concealed from view.

14. The automatic seat lowering apparatus of claim 7, further including a flexible air tube, wherein:

said weight sensor includes at least one foot member extending below said seat, and a resiliently-crushable section of said air tube passing between said foot and said bowl upper surface, whereby said resiliently-crushable section is pinched shut and substantially no air passes through said air tube to exit said piston chamber while an individual sits on said seat, even if said toilet is flushed.

15. The automatic seat lowering apparatus of claim 7, wherein said seat cover lock includes:

a flexible air tube fluidly connected to said piston chamber;

a one-way check valve disposed on said air tube, oriented to allow entry of air into said piston chamber and resist air exit from said piston chamber; and a shut off valve sized and positioned to adjustably prevent air from entering or exiting said air tube, whereby said check valve and said shut off valve cooperate to selectively resist entry of air into said piston chamber and to consistently resist exit of air from said piston chamber, thereby preventing unwanted lifting of said seat lid, yet allowing automated lowering of said toilet seat when said toilet seat is vacant and said toilet has been flushed.

16. The automatic seat lowering apparatus according to claim 7 wherein:

said toilet seat and said seat lid include magnets located and oriented to selectively provide a coupling force such that said seat and said seat lid to move as a unit.

17. The automatic seat lowering apparatus of claim 1, wherein said valve means includes a flush sensor construction fluidly coupled with said control cylinder via an air tube, said flush sensor construction including a weighted valve having a needle projection that selectively seals said air tube and prevents exit of air trapped in said control cylinder until said needle projection is moved to an open position.

18. The automatic seat lowering apparatus of claim 17, wherein said needle projection is moved to an open position in response to motion of a flush lever attached to said weighted valve.

19. The automatic seat lowering apparatus of claim 1, further including a sliding bar positioned to selectively resist motion of said seat cover with respect to said toilet bowl.

20. The automatic seat lowering apparatus of claim 1, wherein said valve means includes a motion sensor.

* * * * *